US007013583B2

(12) United States Patent
Greene et al.

(10) Patent No.: US 7,013,583 B2
(45) **Date of Patent: *Mar. 21, 2006**

(54) FOOTWEAR WITH REMOVABLE FOOT-SUPPORTING MEMBER

(75) Inventors: Pamela S. Greene, Portland, OR (US); Kevin W. Hoffer, Portland, OR (US); Sergio G. Lozano, Beaverton, OR (US); Michael Martindale, Portland, OR (US); Gordon A. Valiant, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 227 days.

This patent is subject to a terminal disclaimer.

(21) Appl. No.: 10/734,114

(22) Filed: Dec. 15, 2003

(65) Prior Publication Data

US 2004/0123495 A1 Jul. 1, 2004

Related U.S. Application Data

(62) Division of application No. 09/990,100, filed on Nov. 21, 2001, now Pat. No. 6,684,532.

(51) Int. Cl.
*A43B 13/14* (2006.01)

(52) U.S. Cl. ..... 36/28; 36/25 R; 36/30 R; 36/31; 36/44; 36/29; 36/144; 36/174; 36/180

(58) Field of Classification Search ..... 36/103, 36/25 R, 28, 30 R, 37, 44, 29, 144, 174, 36/180, 182
See application file for complete search history.

(56) References Cited

U.S. PATENT DOCUMENTS

| | | | |
|---|---|---|---|
| 1,602,675 | A | 10/1926 | Hurley |
| 3,021,846 | A | 2/1962 | Scholl |
| 4,003,146 | A | 1/1977 | Meier et al. |
| 4,124,946 | A | 11/1978 | Tomlin |
| 4,128,951 | A | 12/1978 | Tansill |
| 4,180,924 | A | 1/1980 | Subotnick |
| 4,183,156 | A | 1/1980 | Rudy |
| 4,219,945 | A | 9/1980 | Rudy |
| 4,255,877 | A | 3/1981 | Bowerman |
| 4,287,675 | A | 9/1981 | Norton et al. |
| 4,297,797 | A | 11/1981 | Meyers |
| 4,354,318 | A | 10/1982 | Frederick et al. |
| 4,364,188 | A | 12/1982 | Turner et al. |
| 4,364,189 | A | 12/1982 | Bates |
| 4,445,283 | A | 5/1984 | Meyers |
| 4,597,195 | A | 7/1986 | Dananberg |

(Continued)

FOREIGN PATENT DOCUMENTS

| | | |
|---|---|---|
| DE | 831873 | 1/1952 |

(Continued)

*Primary Examiner*—Ted Kavanaugh
(74) *Attorney, Agent, or Firm*—Banner & Witcoff, Ltd.

(57) ABSTRACT

An article of footwear is disclosed having an upper, a foot-supporting member, and a sole structure. The foot-supporting member includes a heel region located at a greater elevation than a forefoot region, thereby defining a recess under the heel region. The sole structure includes a midsole that forms a protrusion on the interior of the footwear. The protrusion mates with the recess to provide support for the heel region. The foot-supporting member may also incorporate pronation control characteristics, including a downward cant from a medial to a lateral side of the foot-supporting member and a region of reduced support generally underlying the first metatarsal. To further reduce the rate of pronation, the sole structure includes a region in the rear-lateral corner that is more compressible than other areas of the sole structure.

22 Claims, 6 Drawing Sheets

U.S. PATENT DOCUMENTS

| | | | | |
|---|---|---|---|---|
| 4,627,178 | A | 12/1986 | Sullivan et al. | |
| 4,689,898 | A | 9/1987 | Fahey | |
| 4,756,096 | A | 7/1988 | Meyer | |
| 4,813,157 | A | 3/1989 | Boisvert et al. | |
| 4,823,420 | A | 4/1989 | Bartneck | |
| 4,906,502 | A | 3/1990 | Rudy | |
| 4,942,679 | A * | 7/1990 | Brandon et al. | 36/102 |
| 5,036,851 | A | 8/1991 | Cohen | |
| 5,068,983 | A | 12/1991 | Marc | |
| 5,083,361 | A | 1/1992 | Rudy | |
| 5,247,742 | A | 9/1993 | Kilgore et al. | |
| 5,282,326 | A | 2/1994 | Schroer, Jr. et al. | |
| 5,297,349 | A | 3/1994 | Kilgore | |
| 5,625,964 | A | 5/1997 | Lyden et al. | |
| 5,993,585 | A | 11/1999 | Goodwin et al. | |
| 6,023,857 | A | 2/2000 | Vizy et al. | |
| 6,119,371 | A | 9/2000 | Goodwin et al. | |
| 6,477,792 | B1 | 11/2002 | Sartor | |
| 6,684,532 | B1 * | 2/2004 | Greene et al. | 36/28 |

FOREIGN PATENT DOCUMENTS

| | | |
|---|---|---|
| DE | 3439675 | 10/1984 |
| DE | 3406504 | 8/1985 |
| EP | 0 500 247 | 8/1992 |
| GB | 425749 | 3/1935 |
| GB | 483028 | 4/1938 |
| WO | WO 00/30483 | 6/2000 |

* cited by examiner

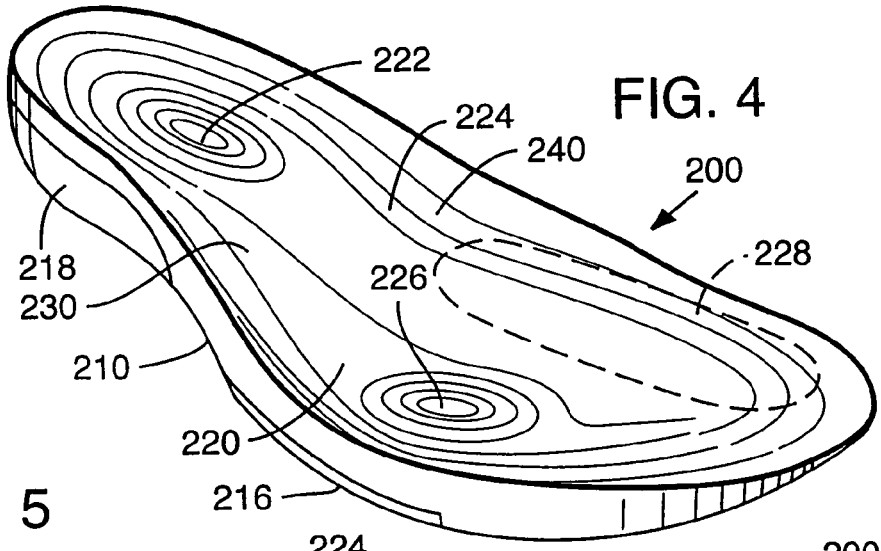
FIG. 4
FIG. 5
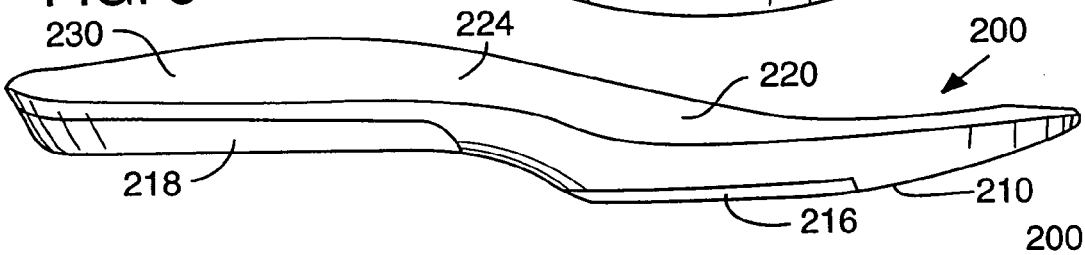
FIG. 6
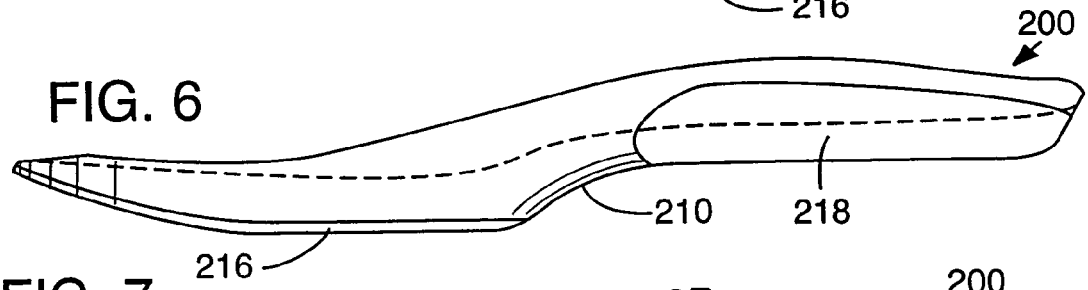
FIG. 7
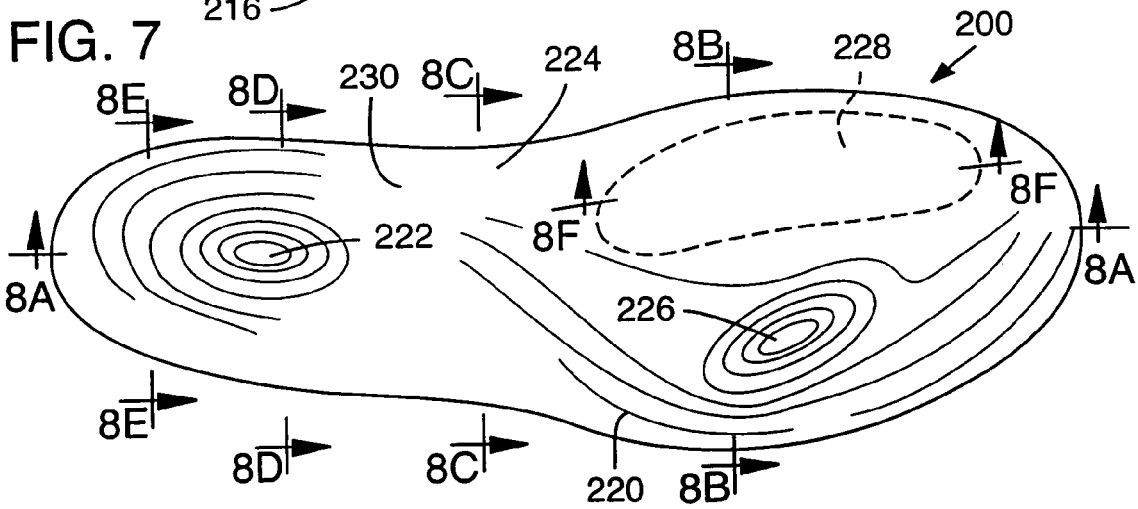

FIG. 8A
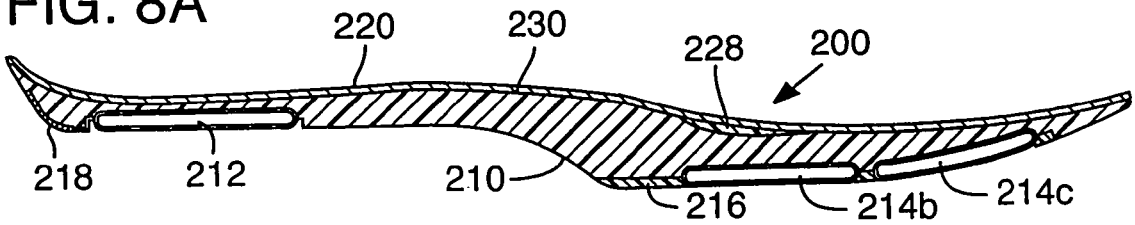
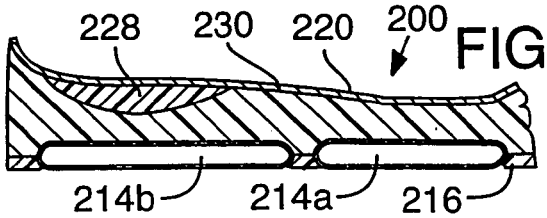
FIG. 8B
FIG. 8C
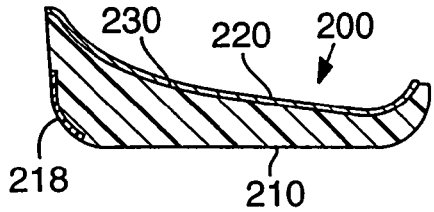
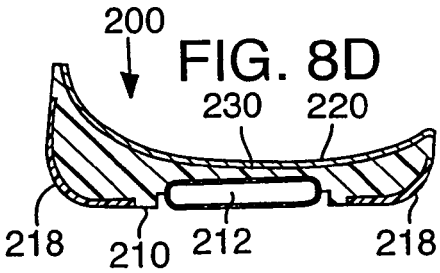
FIG. 8D
FIG. 8E
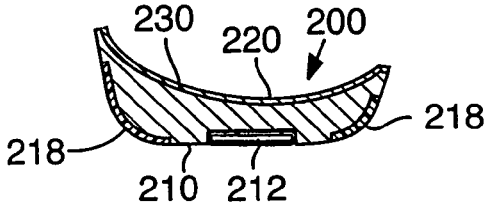
FIG. 8F
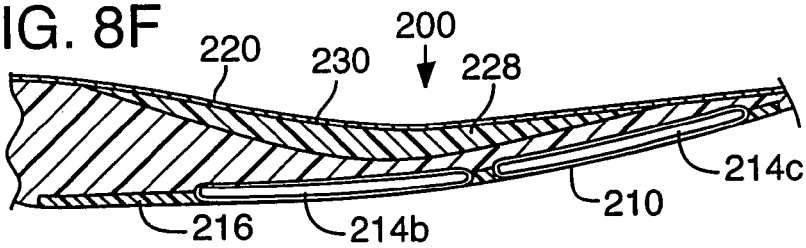

FOOTWEAR WITH REMOVABLE FOOT-SUPPORTING MEMBER

CROSS-REFERENCE TO RELATED APPLICATION

This application is a divisional application of, and claims the benefit of priority to, U.S. patent application Ser. No. 09/990,100, which was filed in the U.S. Patent and Trademark Office on Nov. 21, 2001, now U.S. Pat. No. 6,684,532 and is hereby entirely incorporated by reference.

BACKGROUND OF THE INVENTION

1. Field of the Invention

The present invention relates to footwear. The invention concerns, more particularly, an article of footwear having a removable foot-supporting member.

2. Description of Background Art

One objective of modem athletic footwear design is to minimize weight while maximizing comfort, stability, and durability. In order to meet this goal, designers utilize a broad range of materials, shoe components, and shoe-making methods. The basic design of conventional athletic footwear, however, remains largely uniform and includes two primary elements, an upper and a sole structure. The upper may be formed of leather, synthetic materials, or a combination thereof and comfortably receives the foot while providing ventilation and protection from the elements. The sole structure includes multiple layers that are conventionally referred to as an insole, midsole, and outsole. The insole is a thin, padded member located adjacent to the foot that improves overall comfort of the footwear. In many articles of footwear, the insole is removable and may be replaced. The midsole forms the middle layer of the sole and often incorporate a resilient foam material, such as polyurethane or ethyl vinyl acetate, that attenuates shock and absorbs energy when the footwear is compressed against the ground. Unlike the insole, midsoles are integrally-formed with the footwear and may not be replaced or modified by a wearer. The outsole is fashioned from a durable, wear resistant material, such as carbon-black rubber compound, and typically includes a textured lower surface to improve traction. A disadvantage relating to the laminar design of conventional sole structures is that the overall flexibility of the sole structures are decreased, particularly in the forefoot.

Some modern footwear designs depart from conventional designs by replacing a majority of the midsole with a removable sockliner. Footwear of this type includes an upper, a sockliner, a thin midsole, and an outsole. The sockliner, therefore, functions as the primary shock attenuation and energy absorbing element in both the heel and forefoot regions of the footwear. Although this design provides greater flexibility in the forefoot area than conventional laminar designs, the relatively large thickness of the sockliner in the heel region may cause chafing or blisters due to movement of the foot in relation to the upper.

An important aspect of footwear design involves controlling the motion of the foot during activities that involve running. For many individuals, the motion of the foot while running proceeds as follows: The heel strikes the ground first, followed by the ball of the foot. As the heel leaves the ground, the foot rolls forward such that the toes make contact, and finally the entire foot leaves the ground to begin another cycle. During the time that the foot is in contact with the ground and rolling forward, it also rolls from the lateral side to the medial side, a process called pronation. That is, normally, the outside of the heel strikes first and the toes on the inside of the foot leave the ground last. While the foot is air borne and preparing for another cycle, the opposite process, called supination, occurs. Pronation is a normal and beneficial aspect of running, but may be a potential source of foot and leg injury, particularly if it is excessive.

Footwear designed for individuals with excessive pronation often incorporate pronation control devices to limit the degree of pronation during running. In general, pronation control devices are an additional element, such as a heel counter, or a modification of an existing element, such as the sole structure. In general, a heel counter is a rigid member that extends around the heel portion of the footwear, thereby limiting movement of the heel. Additional support may be provided to a heel counter by including a bead of material, as disclosed in U.S. Pat. No. 4,354,318 to Frederick, et al. Another prior art technique that enhances pronation control following foot impact involves building up the heel counter, as disclosed in U.S. Pat. Nos. 4,255,877 to Bowerman and U.S. Pat. No. 4,287,675 to Norton, et al.

The sole structure may also be modified to control pronation. For example, the medial side of the sole structure may include higher density cushioning materials, as disclosed in U.S. Pat. Nos. 4,364,188 to Turner, et al. and U.S. Pat. No. 4,364,189 to Bates. Similarly, a less compressible fluid chamber may be incorporated into the medial heel area of the sole structure, as disclosed in U.S. Pat. Nos. 4,297,797 and 4,445,283, both to Meyers. Another prior art technique, as disclosed in U.S. Pat. No. 5,247,742 to Kilgore, et al., involves incorporating a compression resistance increasing member into the midsole.

Although the prior art pronation control techniques exhibit a degree of success in controlling pronation, the techniques also add to the weight and manufacturing expense of footwear. The present invention was designed to cooperatively utilize a combination of structural features in a manner that effectively reduces the disadvantages of prior art sole structures.

SUMMARY OF THE INVENTION

The invention relates to an article of footwear that includes an upper for covering at least a portion of a foot of a wearer, a foot-supporting member that is removably-received by the upper, and a sole structure. The foot-supporting member is formed of a resilient material and has a lower surface located opposite a foot-engaging surface. The lower surface is at a first elevation in a forefoot region of the foot-supporting member and the lower surface is at a second elevation in a heel region of the foot-supporting member, the second elevation being greater than the first elevation to define a recess below the heel region. The sole structure is attached to the upper.

In a first embodiment of the present invention, the footwear is configured for running. In order to reduce the rate at which the foot pronates, the foot-engaging surface is structured to have a downward cant in the medial-to-lateral direction and a region of reduced support generally underlying a fore portion of a first metatarsal and aft portions of a proximal hallux of the foot. The downward cant is located in the heel region but may extend throughout the length of the footwear. The region of reduced support may incorporate a material that has a greater compressibility than remaining portions of the foot-supporting member to facilitate plantarflexion. In addition to the downward cant and the region of reduced support, the footwear includes a region in the rear-lateral corner of the midsole that is more compressible than other portions of the midsole. The compressible region serves as a strikezone in the heel that limits pronation. The foot-engaging surface is also contoured to provide support for the foot. The contours include a heel depression, a medial arch support, and a depression underlying the fourth and fifth metatarsal heads. In addition, the heel region is generally raised in relation to the forefoot region.

In a second embodiment of the present invention, the footwear is configured for walking and includes a foot-supporting member that is contoured to provide support for the foot. In addition, the heel region is raised in relation to the forefoot region.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

FIG. 4 is a perspective view of a foot-supporting member of the footwear depicted in FIG. 1.

FIG. 5 is a lateral elevational view of the foot-supporting member depicted in FIG. 4.

FIG. 6 is a medial elevational view of the foot-supporting member depicted in FIG. 4.

FIG. 7 is a top plan view of the foot-supporting member depicted in FIG. 4.

FIGS. 8A to 8F are cross-sectional views of the foot-supporting member, as defined in FIG. 7.

DETAILED DESCRIPTION OF THE INVENTION

Figure 1:
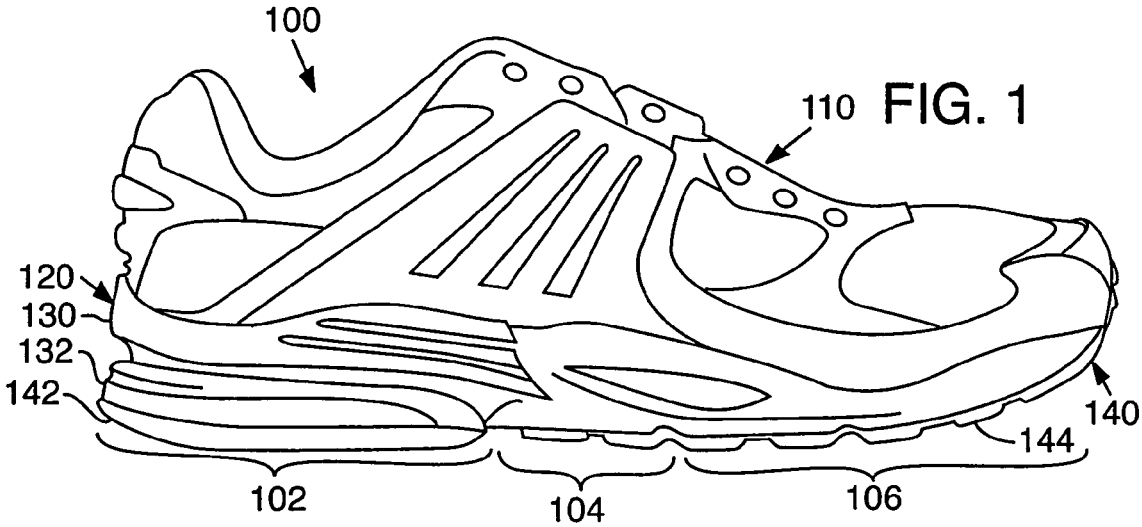
FIG. 1 is a lateral elevational view of an article of footwear in accordance with a first embodiment of the present invention.
Figure 2:
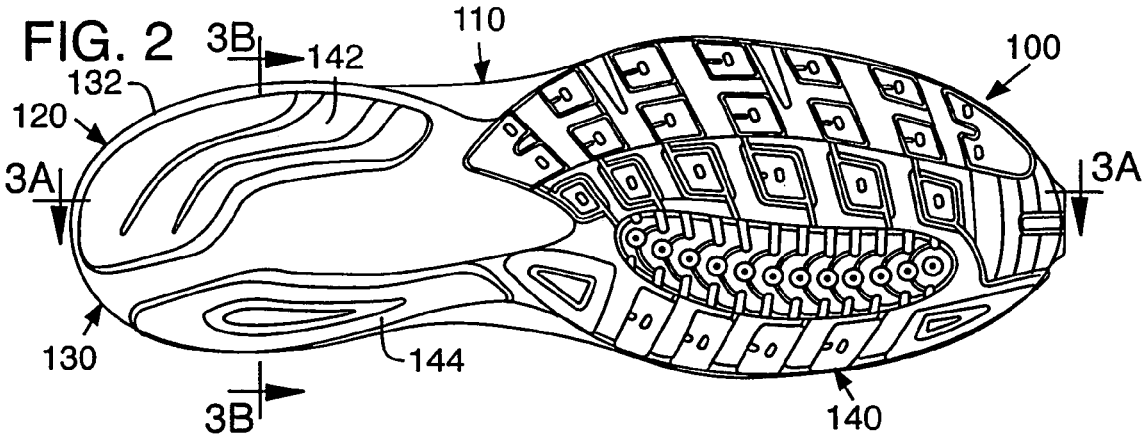
FIG. 2 is a bottom plan view of the article of footwear depicted in FIG. 1.

Referring to the figures, wherein like numerals indicate like elements, articles of athletic footwear in accordance with the present invention are illustrated. FIGS. 1–10 depict a first embodiment of the present invention, an article of footwear 100, which is a running shoe. FIGS. 11–15 depict a second embodiment of the present invention, an article of footwear 300, which is a walking shoe. The concepts disclosed in relation to footwear 100 and 300 may also be applied to other styles of footwear, including tennis shoes, basketball shoes, cross-training shoes, hiking boots, work boots, loafers, boat shoes, or dress shoes. Accordingly, footwear with a variety of intended uses, whether athletic or casual, are intended to fall within the scope of the present invention when coupled with the concepts disclosed herein.

The primary elements of footwear 100 are an upper 110, a sole structure 120 that is attached to upper 110, and a removable foot-supporting member 200. Footwear 100 is divided into three regions: heel region 102, midfoot region 104, and forefoot region 106. Regions 102, 104, and 106 are not intended to demarcate precise areas. Rather, they are intended to define general areas to aid in discussion.

Upper 110 may be any conventional style of upper that performs functions related to the activities for which footwear 100 is designed, particularly running. Sole structure 120 includes a midsole 130 and an outsole 140. Midsole 130 may be formed of any conventional and resilient midsole material, including polyurethane foam and ethyl vinyl acetate, and extends from heel region 1.02 to forefoot region 106. As described below, however, the shock attenuating and energy absorbing characteristics of midsole 130 are primarily limited to heel region 102. Outsole 140 is attached to the lower surface of midsole 130 and provides a durable, ground-contacting surface. Foot supporting member 200 is located above midsole 130 and within the recess formed by upper 110. Depending upon the method by which footwear 100 is manufactured, a portion of upper 110 may extend between foot-supporting member 200 and midsole 130, as depicted in FIG. 3. Alternatively, foot-supporting member 200 may rest directly upon midsole 130.

The primary shock attenuating and energy absorbing element of conventional athletic footwear is an integral foam midsole that extends from the heel to the forefoot regions of the footwear. Conventional midsoles may also incorporate a fluid-filled bladder in accordance with the teachings of U.S. Pat. Nos. 4,183,156, 4,219,945, 4,906,502, and 5,083,361, all issued to Rudy, and U.S. Pat. Nos. 5,993,585, and 6,119,371, both issued to Goodwin, et al., and all hereby incorporated by reference. With regard to footwear 100, however, shock attenuation and energy absorption are divided among sole structure 120 and foot-supporting member 200. More particularly, sole structure 120 is configured such that midsole 130 provides shock attenuation and energy absorption in heel region 102 and foot-supporting member 200 provides shock attenuation and energy absorption in forefoot region 106. With reference to FIG. 3, midsole 130 is depicted as extending from the back of heel region 102 to the front of forefoot region 106. In heel region 102, midsole 130 has a relatively great thickness, thereby imparting a significant degree of shock attenuation and energy absorption. Supplemental shock attenuation and energy absorption may be added to heel region 102 by incorporating a fluid-filled bladder into midsole 130. The thickness of midsole 130 decreases in midfoot region 104 and becomes relatively thin in the forefoot region 106. Accordingly, midsole 130 provides a relatively small degree of shock attenuation and energy absorption in forefoot region 106. Note that around the periphery of footwear 100 midsole 130 extends onto the sides of upper 110 to provide additional lateral and medial support to foot-supporting member 200.

Foot supporting member 200 includes a lower surface 210, an opposite foot-engaging surface 220, and a top cloth 230 attached to foot-engaging surface 220. Lower surface 210 is located in two general elevations that correspond with the contours formed on the upper surface of midsole 130. The area of lower surface 210 located in heel region 102 is, therefore, at a generally greater elevation than the area of lower surface 210 located in forefoot region 106. In midfoot region 104, the elevation of lower surface 210 transitions to the elevation of forefoot region 106. Accordingly, lower surface 210 is configured to define a recess in heel region 102 that mates with the upper surface of midsole 130, as depicted in FIG. 3. Foot-engaging surface 220 is located opposite lower surface 210 and is contoured to generally conform to the lower surface of a foot that is received by footwear 100. The area of foot-engaging surface 220 located in heel region 102 is generally at a greater elevation than the area located in forefoot region 106. The difference in elevation between the respective areas of foot-engaging surface 220, however, is not as great as the difference between the areas of lower surface 210. Accordingly, the portion of foot-supporting member 200 located in forefoot region 106 has a greater thickness than the portion in heel region 102. The greater thickness in forefoot region 106 provides the primary means for shock attenuation and energy absorption in forefoot region 106. Top cloth 230 is attached to foot-engaging surface 220 and provides a comfortable area of contact for the foot. Other specific features of foot-engaging surface 220 will be discussed in greater detail below.

Detailed views of foot-supporting member 200 are depicted in FIGS. 4–9. Foot-engaging surface 220 is contoured to conform generally to the lower surface of a foot. The contours include a heel depression 222, an arch elevation 224, and a metatarsal head depression 226. Heel depression 222 generally corresponds with the area that makes contact with the heel of the wearer's foot. The indentation forming heel depression 222 receives the wearer's heel and seats the heel in relation to foot-engaging surface 220. Arch elevation 224, which is located on the medial side of midfoot region 104, provides support to the arch of the wearer's foot. Metatarsal head depression 226 is located in an area of foot-engaging surface 220 generally underlying the fourth and fifth metatarsal heads of a wearer's foot. A suitable material for foot-supporting member 200 includes phylon, a compression molded ethyl vinyl acetate, having a hardness of 53 to 58 degrees on the Asker C scale.

The elevation of foot-engaging surface 220 in heel region 102 is generally greater than the elevation in forefoot region 106, as discussed above. Foot-engaging surface 220 also includes a raised periphery in heel region 102 and midfoot region 104. The raised periphery provides a general depression extending across foot-engaging surface 220 that receives and secures the position of the foot. In alternative embodiments, the raised periphery may completely encircle foot-engaging surface 220.

Foot-engaging surface 220 also includes a downward cant extending from the medial side to the lateral side throughout the length of the foot-engaging surface 220, as depicted in FIGS. 8B, 8C, and 8D. A suitable angle for the downward cant is approximately three degrees, but may be in the range of one to four degrees. In alternative embodiments, the cant may be absent in areas of foot-engaging surface 220 located in forefoot region 106 or may be limited to heel region 102. The cant imparts pronation control by providing greater medial support, thereby lessening the tendency of the foot to rotate medially following heel strike. An advantage of forming the cant in foot-supporting member 200 is that midsole 130 may have a horizontal upper surface and upper 110 may extend vertically from midsole 130, thereby imparting increased stability.

Figure 10:
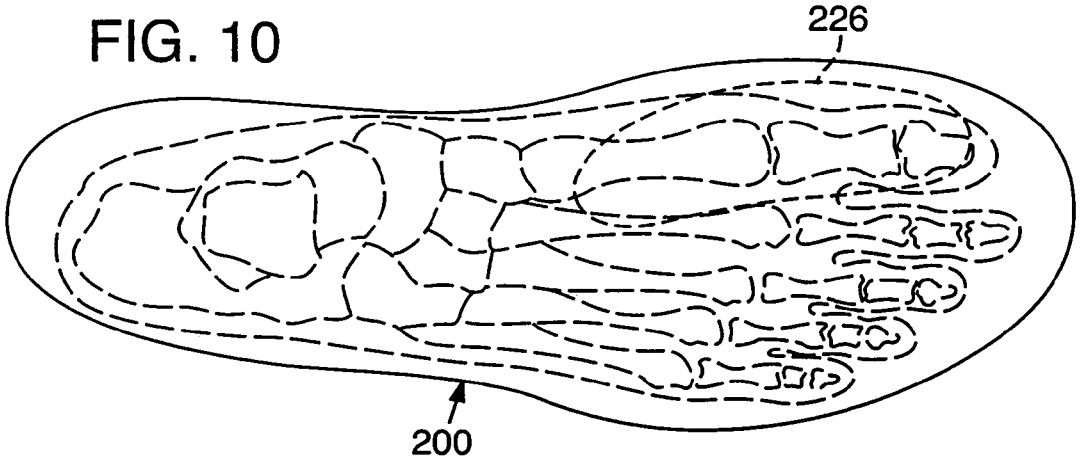
FIG. 10 is a top plan view showing the spatial relationship between bones of a foot and the foot-supporting member depicted in FIG. 4.

A region of reduced support, represented in the figures by region 228, is located in the medial forefoot area of foot-engaging surface 220 and generally underlying a fore portion of a first metatarsal and an aft portion of a proximal hallux of the foot, as depicted in FIG. 10. During toe-off, the fore portion of the first metatarsal head tends to naturally extend below the plane of the remaining portions of the foot. Region 228 facilitates the downward movement of the first metatarsal head by incorporating a foam material under the first metatarsal and aft portion of the proximal hallux that is more compressible than the foam material under other portions of the foot. In forming foot-supporting member 220, a shallow depression corresponding with the area of region 228 is formed in foot-engaging surface 220. A material having greater compressibility than the primary portion of foot-supporting member 220 is then positioned in region 228 and secured through heat bonding or an adhesive, for example. The material forming region 228 may be the same as the foam forming foot-supporting member 200, but with a lower density to provide increased compliance. As discussed above, foot-supporting member 200 may be primarily formed of phylon. A suitable material for region 228 is, therefore, a polyurethane foam material having a hardness that is approximately 10 degrees less on the Asker C scale than the phylon material forming remaining portions of foot-supporting member 200.

Conventional articles of footwear are manufactured on a last having the shape of the human foot. In general, the upper is formed around the last, thereby configuring a recess within the upper that has the general shape of the foot. A sole is then attached to the upper. With regard to footwear 100, however, the recess formed within upper 110 is configured to receive both the foot and foot-supporting member 200. Consequently, footwear 100 may be formed using a unique slip-lasting technique wherein the last has a lower surface that conforms to the shape of lower surface 210. According to this process, upper 110 is formed around the last and sole structure 120 is then attached to upper 110. Removal of the last from upper 110 forms a recess within footwear 100 that accommodates both the foot and foot-supporting member 200. Accordingly, foot-supporting member 200 is inserted into footwear 100 through the ankle opening. Foot-supporting member 200 is, therefore, removably-received by footwear 100. Alternatively, foot-supporting member 200 may be permanently secured within footwear 100.

The structure of footwear 100, particularly the removable nature of foot-supporting member 200, permits footwear 100 to be customized for a particular individual. Individuals with specific footwear needs may obtain replacement foot-supporting members 200 that conform to the specific needs of the individual. For example, an individual may require a foot-supporting member with a greater arch elevation or additional features that limit pronation. Furthermore, a foot-supporting member 200 may be custom manufactured to provide a physician-prescribed medical or therapeutic benefit.

Figure 3A:
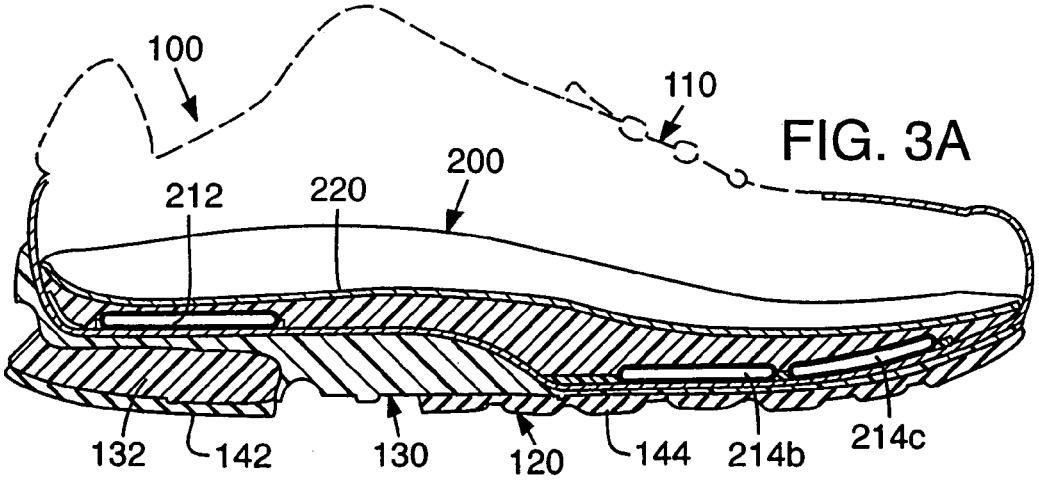
FIG. 3A is a first partial cross-sectional view of the footwear, as defined by line 3A—3A in FIG. 2.
Figure 3B:
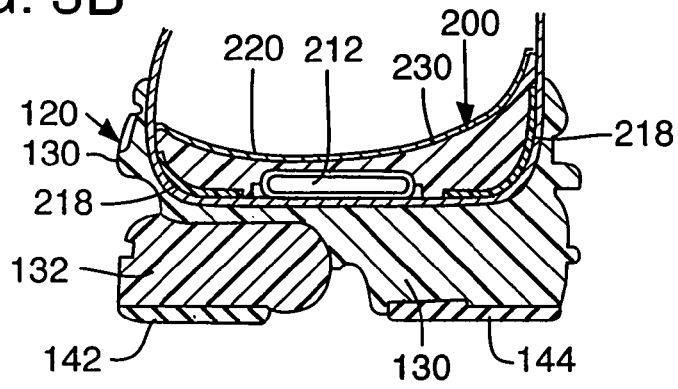
FIG. 3B is a second partial cross-sectional view of the footwear, as defined by line 3B—3B in FIG. 2.
Figure 9:
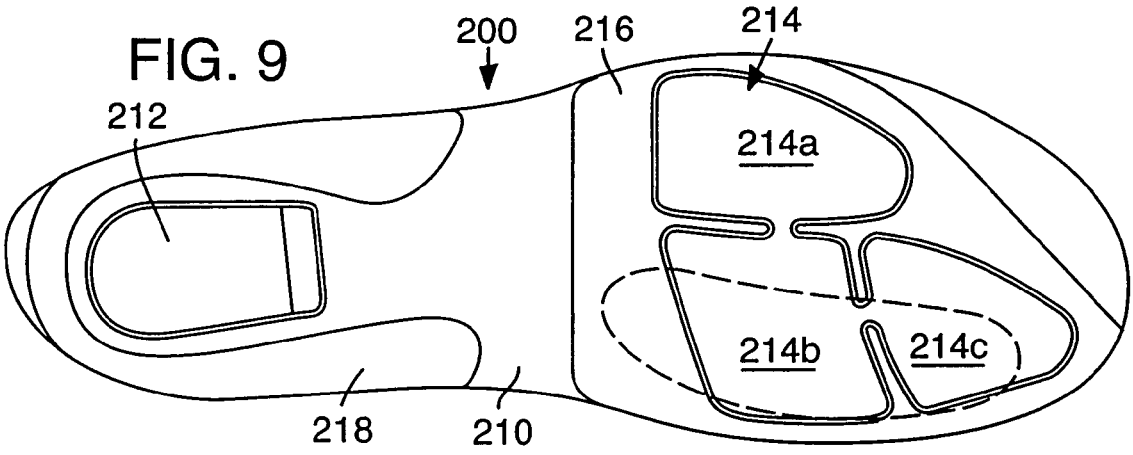
FIG. 9 is a bottom plan view of the foot-supporting member depicted in FIG. 4.

An additional feature of footwear 100 relates to midsole 130. To reduce the rate at which the foot pronates, a portion 132 of midsole 130, which is located in the rear-lateral corner of heel region 102 has greater compressibility than other portions of midsole 130. As discussed in the Description of Background Art section, the outside of the heel, or the rear-lateral corner of the heel region, typically makes contact with the ground first. When the rear-lateral corner of footwear 100 contacts the ground, portion 132 compresses. As the foot rolls forward and to the medial side, the compressive force is transferred to the remaining portion of midsole 130. Because the remaining portion is less compressible than portion 132, the remaining portion resists the lateral-to-medial movement, thereby reducing the rate at which the foot pronates. To facilitate compression of the rear-lateral corner, outsole 140 is articulated, or divided into a first section 142 and a second section 144, as depicted in FIGS. 3A and 3B. First section 142 is located directly beneath portion 132 and second section 144 is located beneath the remainder ofmidsole 130. The area separating first section 142 from second section 144 defines a line of flexion along which midsole 130 flexes when the rear-lateral corner is compressed. A suitable material for midsole 130 is ethyl vinyl acetate having a hardness of 53 to 58 degrees on the Asker C scale. Portion 132 may be formed of a differing material, such as polyurethane having a hardness that is approximately 10 degrees less than the hardness of the ethyl vinyl acetate. The difference, however, may range between 5 and 15 degrees.

The rate at which the foot pronates is also limited by features incorporated into foot-supporting member 200. Heel depression 222, arch elevation 224, and metatarsal head depression 226 function to support the foot, particularly the arch of the foot, thereby permitting the natural structure of the foot to reduce pronation. In addition, foot-engaging surface includes the downward cant that extends from the medial side to the lateral side throughout the length of the foot-engaging surface 220. The cant provides greater support on the medial side of footwear 100, thereby resisting pronation of the foot. Finally, region 228 permits the foot to achieve a natural positioning during toe-off in order to provide additional resistance to pronation.

Lower surface 210 may also include two fluid-filled bladders. A first bladder 212 may be located in heel region 102 and a second bladder 214 may be located in forefoot region 106. Second bladder 214 may include a first chamber 214*a* generally underlying joints between metatarsals and phalanges on a lateral side of the foot, a second chamber 214*b* generally underlying joints between metatarsals and phalanges on a medial side of the foot, and a third chamber 214*c* generally underlying a proximal hallux and a distal hallux of the foot. First chamber 214*a* and second chamber 214*b* may be connected by a conduit to place them in fluid communication. Similarly, second chamber 214*b* and third chamber 214*c* may be connected by a conduit to place them in fluid communication. A tensile member (not shown) may be disposed on the interior of each chamber to restrain outward movement of sheets that form second bladder 214. The tensile member may be of the type disclosed in U.S. Pat. Nos. 4,906,502 and 5,083,361, both issued to Rudy, and U.S. Pat. Nos. 5,993,585 and 6,119,371, both issued to Goodwin, et al. To provide additional support to the area surrounding second bladder 214 a cage 216 formed of a flexible material, such as ethyl vinyl acetate or a rubberized ethyl vinyl acetate, may be located around peripheral portions of second bladder 214.

Additional support for heel region 102 may be provided by a plate 218 located on lower surface 210. Plate 218 may have a u-shape that extends around heel region 102. Suitable materials for plate 218 include semi-rigid polymers or a composite material that combine glass or carbon fibers, for example, with a polymer.

Based upon the above discussion, footwear 100 is designed to be a lightweight running shoe that incorporates features for reducing the rate at which the foot pronates. Foot-supporting member 200 is removable and provides the option of interchanging a first foot-supporting member 200 with a second foot-supporting member 200 that has characteristics uniquely-suited to the individual. In addition, foot-supporting member may be custom manufactured for the individual and inserted into footwear 100.

Figure 11:
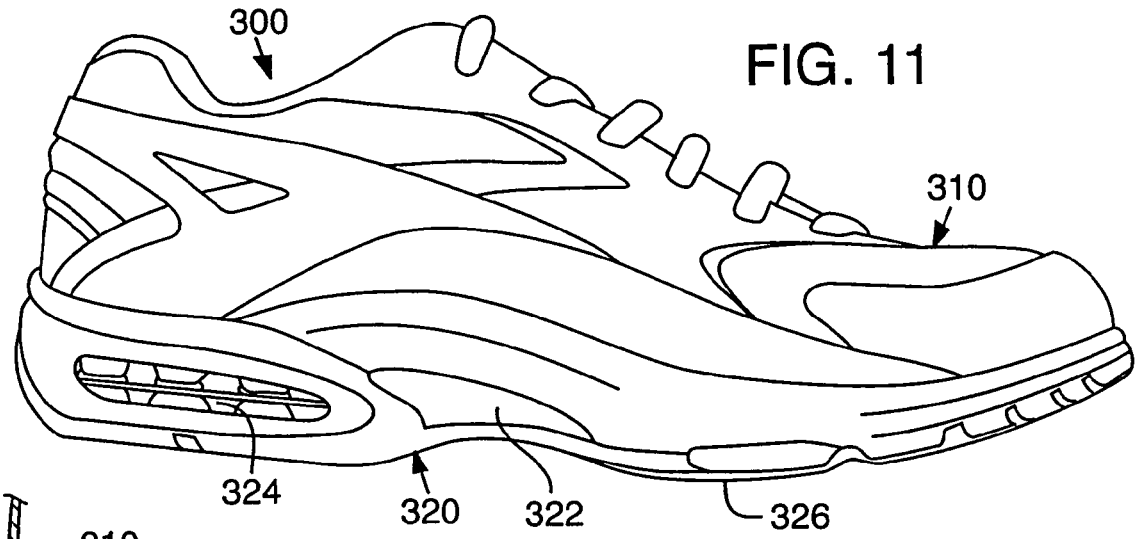
FIG. 11 is a lateral elevational view of an article of footwear in accordance with a second embodiment of the present invention.
Figure 12:
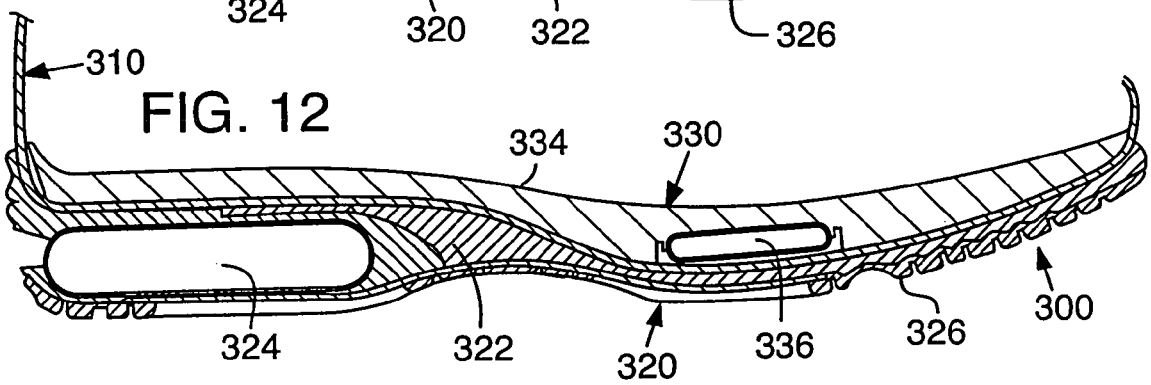
FIG. 12 is a partial cross-sectional lateral elevational view along a longitudinal centerline of the article of footwear depicted in FIG. 11.
Figure 13:
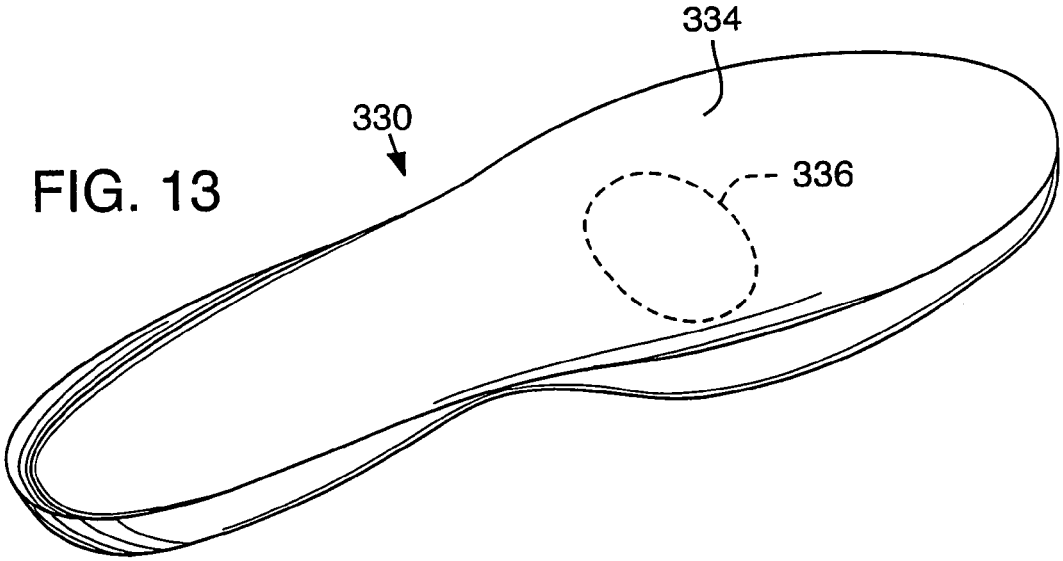
FIG. 13 is a perspective view of a foot-supporting member of the footwear depicted in FIG. 11.
Figure 14:
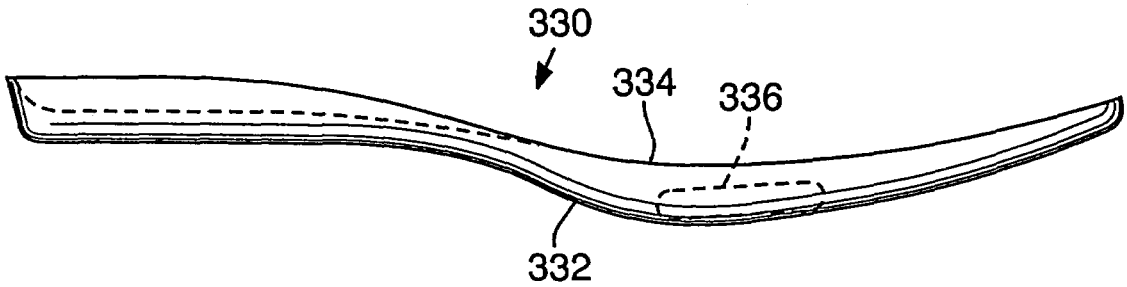
FIG. 14 is a lateral elevational view of the foot-supporting member depicted in FIG. 12.
Figure 15:
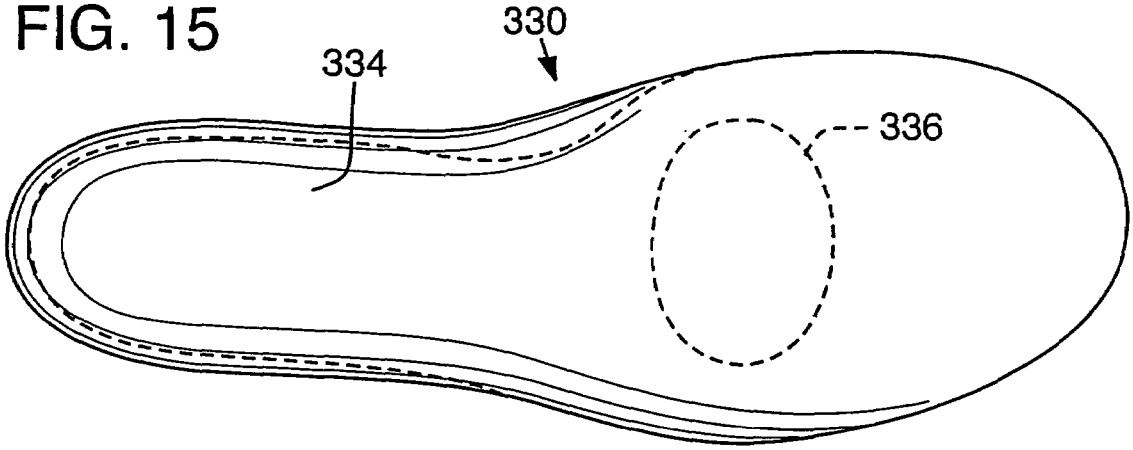
FIG. 15 is a top plan view of the foot-supporting member depicted in FIG. 12.

Footwear 300, a walking shoe in accordance with the second embodiment of the present invention, is depicted in FIGS. 11–15 and includes an upper 310, a sole structure 320, and a foot-supporting member 330. Sole structure 320 is attached to upper 310 and configured to receive foot-supporting member 330. The primary elements of sole structure 320 include a midsole 322, a fluid-filled bladder 324 located in the heel portion of midsole 322, and an outsole 326. Midsole 322 may be formed of single material or multiple materials having differing properties. As depicted in FIG. 12, midsole 322 is formed of differing materials in the heel and forefoot portions. A suitable material for the heel portion is polyurethane having a hardness of 54 to 60 degrees on the Asker C scale. The forefoot portion mat be formed from phylon having a hardness of 50 to 55 degrees on the Asker C scale. Foot-supporting member 330 may be formed of polyurethane, having a density of 0.35 grams per cubic centimeter and a hardness of 28 to 34 on the Asker C scale, and includes a lower surface 332 and a contoured foot-engaging surface 334. As with midsole 130 of footwear 100, midsole 322 is primarily located in the heel region such that foot supporting member 330 is configured to have a greater elevation in the heel region. For increased shock attenuation and energy absorption, lower surface 332 may incorporate a fluid-filled bladder 336 in the forefoot region. In addition, a similar fluid-filled bladder 338 may be incorporated into a portion of sole structure 320 located in the heel region, as depicted in FIGS. 11 and 12. For ease of illustration, the interior of bladders 336 and 338 are illustrated without connections between the top and bottom surfaces. Conventional bladders with interior connections are preferably used, as disclosed in U.S. Pat. No. 4,817,304 to Parker, et al, hereby incorporated by reference, and the aforementioned U.S. Pat. Nos. 4,906,502 and 5,083,361 to Rudy.

A first advantage of footwear 300 over prior art footwear styles relates to the flexibility of sole structure 320. The laminar design of prior art sole structures limits overall flexibility. Sole structure 320, however, utilizes a separate foot-supporting member 330 in place of a conventional midsole in the forefoot. The separate design permits greater flexibility in the forefoot, particularly in the area corresponding with the joints between the metatarsals and phalanges of the wearer. A second advantage of footwear 300 relates to the thickness of foot-supporting member 330 in the heel region. As discussed in the Description of Background Art section, prior art sockliners with a relatively great thickness in the heel region had the potential to cause chafing and blisters due to movement of the foot in relation to the upper. This issue is resolved in footwear 300 by reducing the thickness of foot-supporting member 330 and increasing the thickness of midsole 322 in the heel region. Footwear 100 has a similar configuration and, therefore, benefits from these advantages.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. An article of athletic footwear comprising:

an upper for covering at least a portion of a foot of a wearer;

a foot-supporting member that is removably-received by the upper, the foot-supporting member having a lower surface located opposite a foot-engaging surface, the lower surface being at a first elevation in a forefoot region of the foot-supporting member and the lower surface being at a second elevation in a heel region of the foot-supporting member, the second elevation being greater than the first elevation to define a recess below the heel region, the foot-supporting member also having a first thickness in the forefoot region and a second thickness in the heel region, the first thickness being greater than the second thickness throughout a substantial portion of the forefoot region; and a sole structure attached to the upper, the sole structure including a polymer foam material located under at least the heel region of the foot-supporting member, the foam having greater thickness under the heel region than under the forefoot region.

2. The article of footwear of claim 1, wherein the foot-engaging surface includes a depression in the heel region for receiving a heel of the foot.

3. The article of footwear of claim 2, wherein the foot-engaging surface includes a depression in an area generally underlying fourth and fifth metatarsal beat of the foot.

4. The article of footwear of claim 3, wherein the foot-engaging surface includes a first elevated region in an area generally underlying a medial arch of the foot.

5. The article of footwear of claim 4, wherein the foot-engaging surface includes a second elevated region in peripheral areas of the foot-engaging surface.

6. The article of footwear of claim 1, wherein the foot-supporting member incorporates a fluid-filled bladder.

7. The article of footwear of claim 1, wherein the foot-supporting member includes a downward cant from a medial to a lateral side of the foot-engaging surface.

8. The article of footwear of claim 1, wherein the foot-engaging surface includes a region of reduced support in a medial forefoot area, the foot-supporting member being substantially formed of a first material and the region of reduced support including a second material, the first material being less compressible than the second material.

9. The article of footwear of claim 8, wherein the region of reduced support is located adjacent a fore portion of a first metatarsal and an aft portion of a proximal hallux of the foot of the wearer.

10. The article of footwear of claim 1, wherein the foot-engaging surface is at a third elevation in the forefoot region and the foot-engaging surface is at a fourth elevation at the heel region, the third elevation being less than the fourth elevation.

11. The article of footwear of claim 1, wherein a heel plate is incorporated into the foot-supporting member in the heel region.

12. An article of footwear, comprising:

an upper for covering at least a portion of a foot of a wearer;

a foot-supporting member that is removably-received by the upper, the foot-supporting member being formed of a resilient material and having a foot-engaging surface with a downward cant extending from a medial to a lateral side of the foot-supporting member, and the foot-engaging surface including a region of reduced support located in a medial forefoot area, the region of reduced support providing less support than a lateral forefoot area, the foot-supporting member also having a first thickness in a forefoot region and a second thickness in a heel region, the first thickness being greater than to second thickness; and a sole structure attached to the upper.

13. The article of footwear of claim 12, wherein the foot-supporting member includes a lower surface located opposite the foot-engaging surface, the lower surface being at a first elevation in a forefoot region of the foot-supporting member and the lower surface being at a second elevation in a heel region of the foot-supporting member, the first elevation being less than the second elevation to define a recess located under the heel region.

14. The article of footwear of claim 13, wherein the sole structure includes a midsole, a portion of the midsole forming an upward protrusion that mates with the recess for supporting the heel region of the foot-supporting member.

15. The article of footwear of claim 13, wherein the foot-engaging surface is at a third elevation in the forefoot region and the foot-engaging surface is at a fourth elevation in the heel region, the third elevation being less than the fourth elevation.

16. The article of footwear of claim 12, wherein the foot-supporting member is substantially formed of a first material and the region of reduced support includes a second material, the first material being less compressible than the second material.

17. The article of footwear of claim 12, wherein the region of reduced support is located adjacent a fore portion of a first metatarsal and an aft portion of a proximal hallux of the foot.

18. The article of footwear of claim 12, wherein the downward cant is located in a heel region and a portion of a midfoot region of the foot-supporting member.

19. The article of footwear of claim 12, wherein to downward cant is approximately three degrees.

20. The article of footwear of claim 12, wherein the sole structure includes a first region and a second region, the first region being located in a rear-lateral corner of the sale structure and being more compressible than the second region.

21. The article of footwear of claim 12, wherein the sole structure includes an outsole having a first section that is attached to the first region and a second section that is attached to the second region, the first section being separate from the second section to define a line of flexion in the sole structure.

22. The article of footwear of claim 12, wherein a heel plate is incorporated into a heel region of the foot-supporting member for providing support to the heel region.

* * * * *